US007927254B2

(12) United States Patent
Adams

(10) Patent No.: US 7,927,254 B2
(45) Date of Patent: Apr. 19, 2011

(54) RECREATIONAL STRUCTURE USING A SLEEVE-JOINT COUPLING

(75) Inventor: Craig Adams, Portland, OR (US)

(73) Assignee: CAO6, LLC, Portland, OR (US)

( * ) Notice: Subject to any disclaimer, the term of this patent is extended or adjusted under 35 U.S.C. 154(b) by 610 days.

(21) Appl. No.: 10/905,105

(22) Filed: Dec. 15, 2004

(65) Prior Publication Data

US 2005/0143225 A1 Jun. 30, 2005

Related U.S. Application Data

(63) Continuation-in-part of application No. 60/530,054, filed on Dec. 16, 2003.

(51) Int. Cl.
*A63B 21/00* (2006.01)

(52) U.S. Cl. ..... 482/27; 482/28

(58) Field of Classification Search ..... 63/3, 15.3, 63/15.4, 15.1, 7, 9, 10, 11; 482/27–29, 35–42; 403/218, 217, 378, 377, 169, 170, 109.8, 403/109.1, 231, 174, 297, 296, 314
See application file for complete search history.

(56) References Cited

U.S. PATENT DOCUMENTS

| | | | |
|---|---|---|---|
| 774,393 | A | 11/1904 | Palmer |
| 959,973 | A | 5/1910 | Tomkins |
| 1,488,244 | A | 10/1920 | Hinton |
| 1,830,262 | A | 11/1931 | Carlson |
| 1,850,049 | A | 3/1932 | Cornell, Jr. |
| 1,982,498 | A | 11/1934 | Cornell, Jr. |
| 1,992,312 | A | 2/1935 | Kuehn |
| 2,128,720 | A | 8/1938 | Tweedale |
| 2,430,714 | A | 11/1947 | Geer |
| 2,858,551 | A | 11/1953 | Sidlinger |
| 2,809,383 | A | 10/1957 | Fenner et al. |
| 2,931,129 | A | 4/1960 | Boniface |
| 3,201,126 | A | 8/1965 | Nissen |
| 3,339,925 | A | 9/1967 | Nissen |

(Continued)

FOREIGN PATENT DOCUMENTS

AU 2004100729 A4 9/2004

OTHER PUBLICATIONS

H176, Johnstone, Jr., "Slip Tee Pipe Fitting," Dec. 2, 1986.

(Continued)

*Primary Examiner* — Jerome Donnelly
(74) *Attorney, Agent, or Firm* — Harness, Dickey & Pierce, PLC

(57) ABSTRACT

A recreational structure, such as a trampoline frame, can be quickly and reliably assembled using a sleeve-joint coupling having a "T" configuration. A first arm member and an aperture that is formed in the sleeve-joint coupling are disposed in an opposite relationship. A second arm member and a third arm member are disposed in an opposite relationship with each other. The first arm member receives one end of a vertical frame member of the recreational structure, while the aperture receives one end of a vertical pole member of, for example, a safety enclosure. The second and third arm members each receive one end of a horizontal frame member of the recreational structure. The vertical pole member extends through the sleeve-joint coupling into an inner portion of the vertical frame member received by the first arm of the sleeve-joint coupling.

18 Claims, 11 Drawing Sheets

U.S. PATENT DOCUMENTS 3,502,357 A 3/1970 Wagner
3,837,643 A 9/1974 Lee
3,988,872 A 11/1976 Adamson et al.
4,008,971 A 2/1977 Wah et al.
4,139,192 A 2/1979 McNeil
4,157,801 A 6/1979 Elmer
RE30,344 E 7/1980 McNeil
4,284,271 A 8/1981 Pettit et al.
4,339,123 A * 7/1982 Rich ..... 482/28
4,359,851 A 11/1982 Daniels
4,370,790 A 2/1983 Rodaway
4,386,772 A 6/1983 Wu
4,413,361 A 11/1983 Wolf et al.
4,433,838 A 2/1984 Gordon
4,478,420 A 10/1984 Sowards
4,480,941 A 11/1984 Gilb et al.
4,514,107 A 4/1985 Moreno
4,540,309 A 9/1985 Hansson
4,569,515 A 2/1986 Gordon
4,572,695 A 2/1986 Gilb
4,598,905 A 7/1986 Vrana
4,644,892 A 2/1987 Fisher
4,703,769 A 11/1987 Harrison, Jr.
4,776,581 A 10/1988 Shepherdson
4,836,530 A 6/1989 Stanley, Jr.
4,863,156 A 9/1989 Shaw
4,885,883 A 12/1989 Wright
4,900,011 A 2/1990 Nolet
5,010,603 A 4/1991 Hertzog
5,040,716 A 8/1991 Stetz
D328,199 S 7/1992 Matsch
D328,940 S 8/1992 Matsch
D330,741 S 11/1992 Matsch
D330,742 S 11/1992 Matsch
D330,744 S 11/1992 Matsch
5,230,581 A 7/1993 Deng
5,269,533 A 12/1993 Kellams
5,299,839 A 4/1994 Mogavero
5,364,313 A 11/1994 Nickelson
5,390,913 A 2/1995 Kepler
5,399,132 A * 3/1995 Bailey ..... 482/29
5,469,678 A 11/1995 Zamerovsky
5,545,110 A 8/1996 Hsiang
5,549,067 A 8/1996 Jolin
5,575,738 A 11/1996 Millington et al.
D376,405 S 12/1996 Strawcutter et al.
5,590,974 A * 1/1997 Yang ..... 403/327
5,617,697 A 4/1997 Erwin
D382,618 S 8/1997 Gift
5,664,769 A 9/1997 Sadinsky et al.
5,674,157 A * 10/1997 Wilkinson ..... 482/83
5,711,743 A 1/1998 Nichols, Jr. et al.
5,810,695 A 9/1998 Sass
5,833,557 A 11/1998 Cole
5,876,311 A 3/1999 Coates et al.
5,921,049 A 7/1999 Sugiyama
5,941,798 A 8/1999 Coan et al.
6,001,045 A 12/1999 Gift et al.
6,017,292 A 1/2000 Gift et al.
6,032,431 A 3/2000 Sugiyama
6,053,845 A 4/2000 Publicover et al.
6,110,074 A 8/2000 Tacquet
6,135,921 A 10/2000 Holland et al.
6,135,922 A 10/2000 Nissen
6,162,061 A 12/2000 Taylor
6,193,632 B1 2/2001 Steger
6,216,717 B1 * 4/2001 Chen ..... 135/130
6,261,207 B1 * 7/2001 Publicover et al. ..... 482/27
6,319,174 B1 11/2001 Alexander
6,402,414 B1 6/2002 Kanodia et al.
6,402,662 B1 6/2002 Rieber
6,413,004 B1 * 7/2002 Lin ..... 403/176
6,450,187 B1 9/2002 Lin et al.
6,478,039 B2 11/2002 Suh
6,607,468 B1 8/2003 Nichols, Jr. et al.
6,742,202 B2 6/2004 Jones
6,748,962 B2 6/2004 Miller
6,802,169 B2 10/2004 Simmons
6,846,271 B2 1/2005 Publicover
7,182,713 B2 * 2/2007 Wang et al. ..... 482/35
7,241,072 B2 * 7/2007 Patrignani ..... 403/174
2002/0137598 A1 9/2002 Publicover et al.
2003/0026645 A1 2/2003 Hoke, Jr.
2003/0036460 A1 2/2003 Publicover
2003/0104905 A1 6/2003 Publicover
2004/0091307 A1 5/2004 James
2004/0121883 A1 6/2004 Publicover
2004/0147370 A1 7/2004 Wang et al.
2004/0171461 A1 9/2004 Alexander
2004/0171462 A1 9/2004 Alexander
2004/0176214 A1 * 9/2004 Yueh ..... 482/27
2005/0032609 A1 2/2005 Nissen et al.
2005/0037896 A1 2/2005 Publicover
2005/0084627 A1 4/2005 Alexander
2005/0226683 A1 10/2005 Herb

OTHER PUBLICATIONS

L.H. Teh et al., "Strength of Welded T-Joint Truss Connections Between Equal Width Cold-Formed RHS," Research Report No. R831, Dept. of Civil Engineering, Centre for Advanced Structural Engineering, The University of Sydney, Aug. 2003.

* cited by examiner

VIEW A

RECREATIONAL STRUCTURE USING A SLEEVE-JOINT COUPLING

CROSS-REFERENCE TO RELATED APPLICATION

The present patent application claims priority to U.S. Provisional Patent Application Ser. No. 60/530,054, filed Dec. 16, 2003, entitled "Sleeve-joint Coupling For Recreational Structure," and invented by Craig Adams, and which is incorporated by reference herein.

BACKGROUND OF THE INVENTION

1. Field of the Invention

The present invention relates to recreational structures. More particularly, the present invention relates to a frame arrangement for a recreational structure, such as a trampoline, that uses a sleeve-joint coupling.

2. Description of the Related Art

Recreational structures having frames, such as trampolines, are well-known. For example, a trampoline has a horizontal frame to which a rebounding surface is attached and a plurality of vertical frame members, or legs, that support the horizontal frame and rebounding surface above the ground. While the horizontal and vertical frame portions of a trampoline could be fabricated to be one unitary structure, such a unitary structure is cumbersome when the trampoline frame is transported to a place where the trampoline is used. Accordingly, trampoline frames are typically formed from a plurality of pieces that are fastened together at the time a trampoline is assembled.

A desirable characteristic for all trampoline frames formed from a plurality of pieces is that the various pieces are attached or joined to each other using a technique that is simple, quick to assemble and is reliable.

BRIEF SUMMARY OF THE INVENTION

The present invention provides a technique for joining structural components of a recreational structure, such as a trampoline, that is simple, quick to assemble and is reliable.

The advantages of the present invention are provided by a recreational structure frame system that includes a plurality of horizontal frame members, at least one vertical frame member, at least one vertical pole member, and at least one sleeve-joint coupling. Each horizontal frame member has two ends. Similarly, each vertical frame member has two ends, and each vertical pole member has two ends. In one exemplary embodiment, at least one sleeve-joint coupling has first, second and third arm members arranged to substantially form a T configuration and an aperture that is formed in the sleeve-joint coupling. That is, the first arm member and the aperture are disposed in an opposite relationship with respect to each other, and the second arm member and the third arm member are disposed in an opposite relationship with each other. In another exemplary embodiment, at least one sleeve-joint coupling includes a side sleeve member having the aperture. The first arm member receives one end of a vertical frame member. The aperture receives one end of a vertical pole member. The second and third arm members each receive one end of a horizontal frame member. The vertical pole member received by the aperture extends through the sleeve-joint coupling into an inner portion of the vertical frame member received by the first arm of the sleeve-joint coupling.

The vertical pole member can be part of, for example, a safety enclosure, in which case the safety enclosure can include a plurality of vertical pole members, such that each vertical pole member is received into the aperture of a sleeve-joint coupling. A plurality of horizontal support members can be coupled to two adjacent vertical pole members, thereby forming the safety enclosure. In one exemplary embodiment, the vertical pole member is configured to substantially form an arch.

One exemplary embodiment of a sleeve-joint coupling according to the present invention includes a fourth arm member, in which case the aperture is disposed at an end of the fourth arm member. A tension member can be coupled between adjacent sleeve-joint couplings that applies a force to the adjacent sleeve-joint couplings and forces the adjacent sleeve-joint couplings toward each other.

BRIEF DESCRIPTION OF THE DRAWINGS

The present invention is illustrated by way of example and not by limitation in the accompanying figures in which like reference numerals indicate similar elements and in which:

FIG. 9 depicts a top cutaway view of the first exemplary embodiment of a sleeve-joint coupling according to the present invention; and.

DETAILED DESCRIPTION OF THE INVENTION

Figure 1:
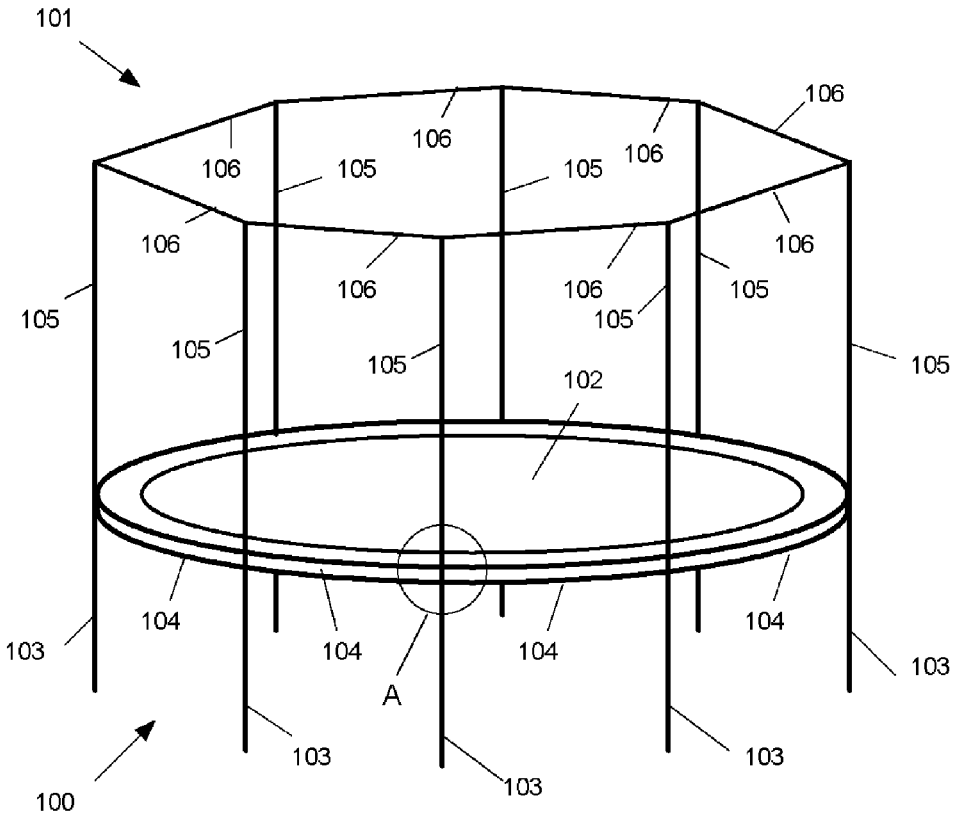
FIG. 1 depicts a perspective view of an exemplary trampoline having an exemplary safety enclosure.

FIG. 1 depicts a perspective view of an exemplary trampoline 100 having an exemplary safety enclosure 101. Trampoline 100 includes a rebounding surface 102 and a frame structure having vertical frame members 103 and a circular frame that can be formed from a plurality of circular frame members 104. Vertical frame members 103 and circular frame members 104 are typically made from hollow metal tubing having sufficient strength to bear the stresses and loads that are associated with trampolines. Safety enclosure 101 includes a frame structure having vertical pole members 105 and horizontal support members 106. A horizontal support member 106 is connected between adjacent vertical pole members in a substantially inflexible manner. A structural member that is suitable for both vertical pole members 105 and horizontal support members 106 is disclosed by U.S. Pat. No. 6,450,187 B1 to Lin et al., which is incorporated by reference herein.

Complete details of trampoline 100 and safety enclosure 101 are not shown in FIG. 1 for simplicity. For example, safety enclosure includes a mesh- or netting-type of material that extends between adjacent vertical pole members 105 and between horizontal frame members 106 and circular frame member 104 that together with circular frame 104, vertical pole members 105 and horizontal support members 106 operate as a fence around rebounding surface 102 in order to keep a user on trampoline 100 and reduce the risk of injury to the user.

Figure 2B:
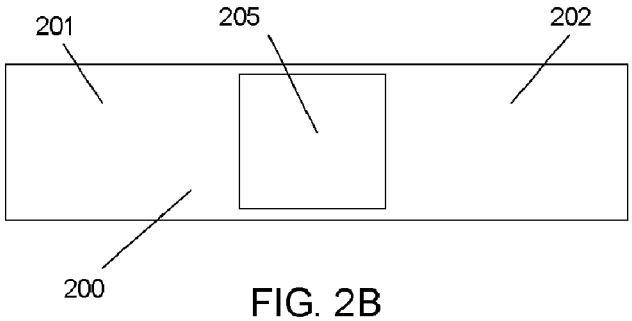
FIGS. 2A-2C respectively show a side view, a top view and an end view of the first exemplary embodiment of a sleeve joint coupling for a trampoline frame according to the present invention.
Figure 2A:
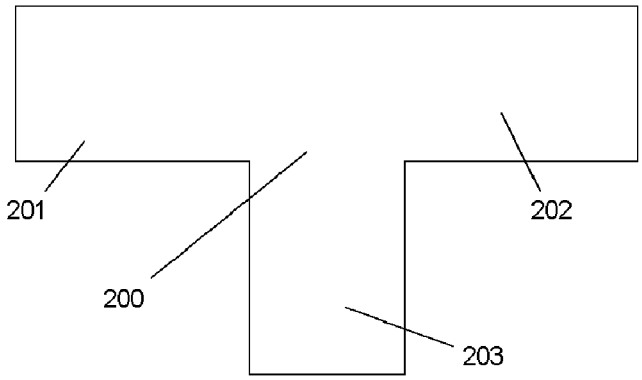
Figure 2C:
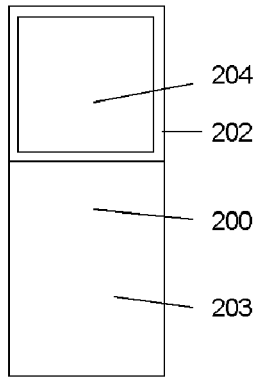
Figure 2D:
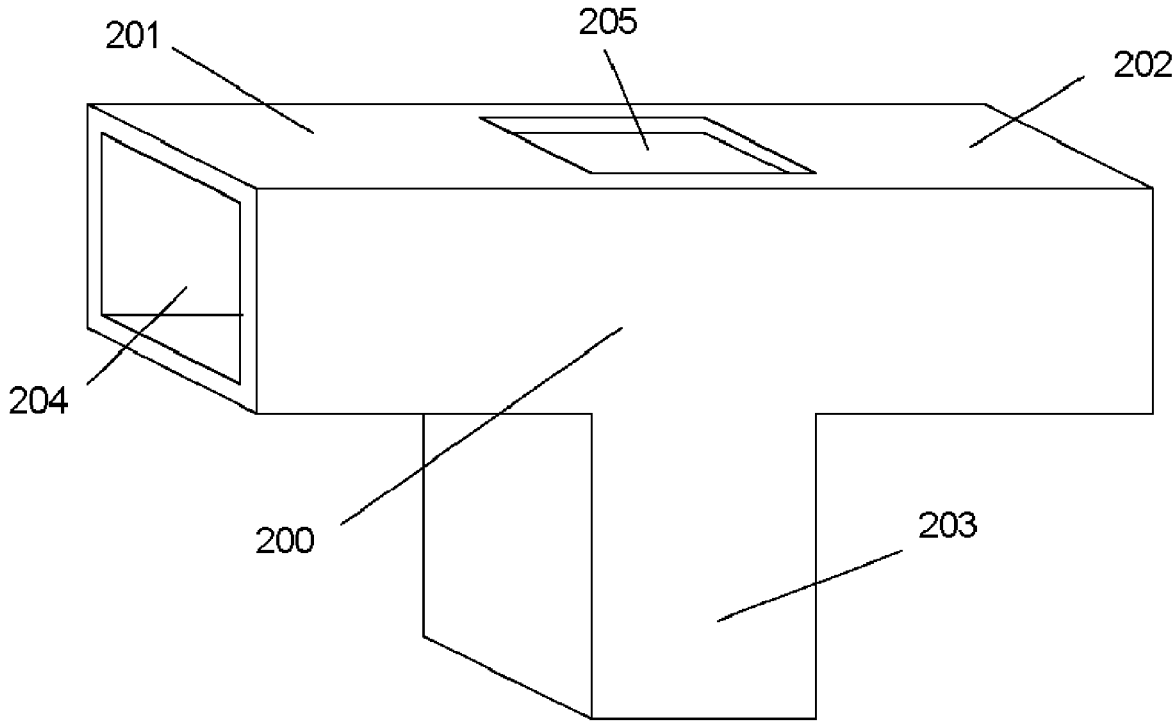
FIG. 2D shows a perspective view of the first exemplary embodiment of a sleeve joint coupling according to the present invention.

According to the present invention, vertical pole members 105 of safety enclosure 101 attach to the frame structure of trampoline 100 using a plurality of sleeve-joint couplings, of which one is indicated at A in FIG. 1. FIGS. 2A-2D and FIG. 3 show details of a first exemplary embodiment of a sleeve-joint coupling according to the present invention. In particular, FIGS. 2A-2C respectively show a side view, a top view and an end view of the first exemplary embodiment of a sleeve-joint coupling 200 for a trampoline frame according to the present invention. FIG. 2D shows a perspective view of sleeve-joint coupling 200. Sleeve joint coupling 200 is generally shaped as a "T" and includes three arm members 201-203, each having a generally square cross-sectional shape. Each arm member 201-203 receives a trampoline frame member (not shown in FIGS. 2A-2C) of similar cross-sectional shape into an opening 204 (FIGS. 2C and 2D). Sleeve joint coupling 200 includes an opening 205, shown in FIG. 2B, that receives a safety enclosure vertical pole member (not shown in FIGS. 2A-2C) having a generally square cross-sectional member.

Figure 3:
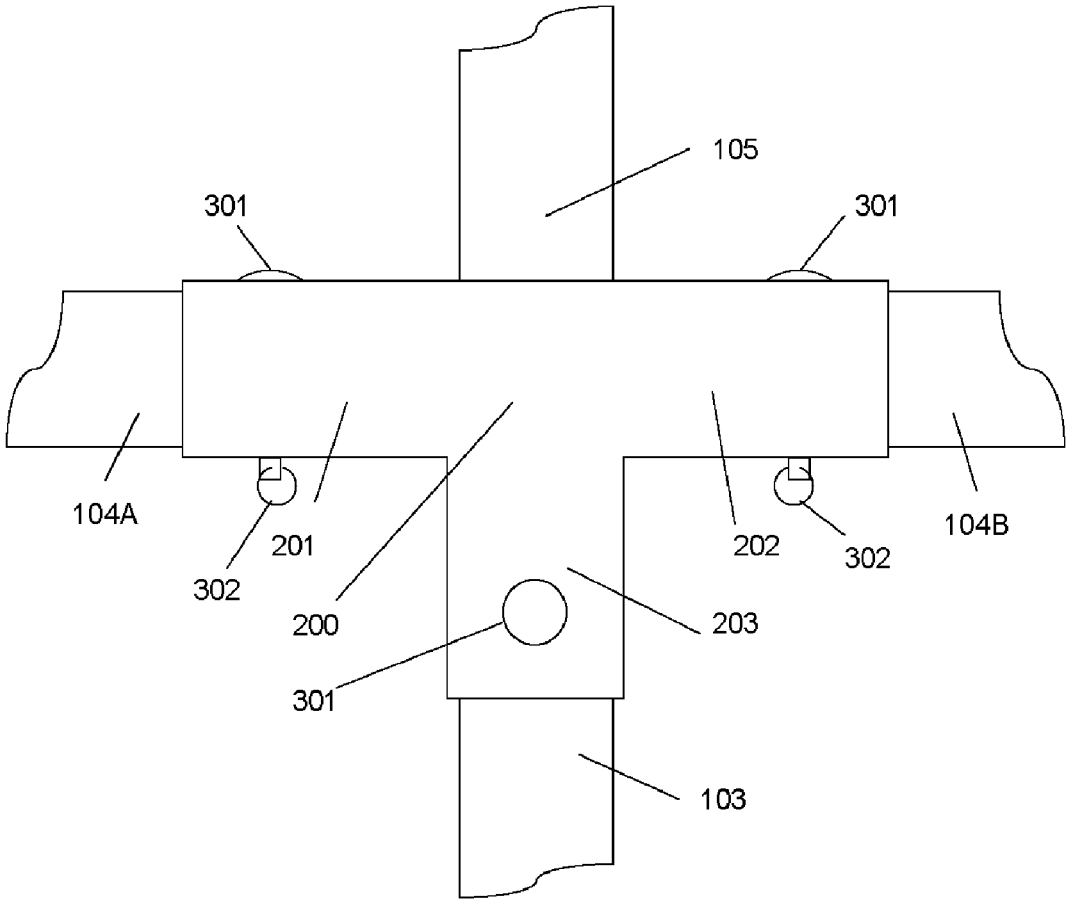
FIG. 3 shows details of a first exemplary embodiment of sleeve-joint coupling according to the present invention.

FIG. 3 depicts View A, shown in FIG. 1, in greater detail. In FIG. 3, sleeve-joint coupling 200 couples circular frame member 104A to circular frame member 104B and to vertical frame member 103. Circular frame members 104A and 104B are secured to sleeve-joint coupling 200 using, for example, pins 301 and cotter rings 302 (not shown in FIGS. 2A-2D). Alternatively, circular frame members 104A and 104B can be secured to sleeve-joint coupling 200 using sheet metal screws, and/or bolts and nuts. As yet another alternative, the inner surface of each arm member of sleeve-joint coupling can be threaded to engage complementary threading on each end of a circular frame member 104 and on one end of a vertical frame member 103. Additionally, a threaded connection between sleeve-joint coupling 200 and a frame member can be secured using a pin and cotter ring arrangement, a sheet metal screw and/or a bolt and nut.

Vertical pole member 105 of safety enclosure 101 is inserted into opening 205 (FIGS. 3B and 3D) and extends through sleeve-joint coupling 200 into vertical frame member 103 a distance that is sufficient to distribute any shearing and/or torquing forces that may be imparted to vertical pole member 105 along the inside of vertical frame member 103 so that vertical frame member 103 does not fail. Vertical pole member 105 can be secured in vertical frame member 103 using, for example, a pin 301 and a cotter ring (not shown). Alternatively, vertical pole member 105 is secured in vertical frame member 103 using a sheet metal screw and/or a bolt and nut.

Figure 4B:
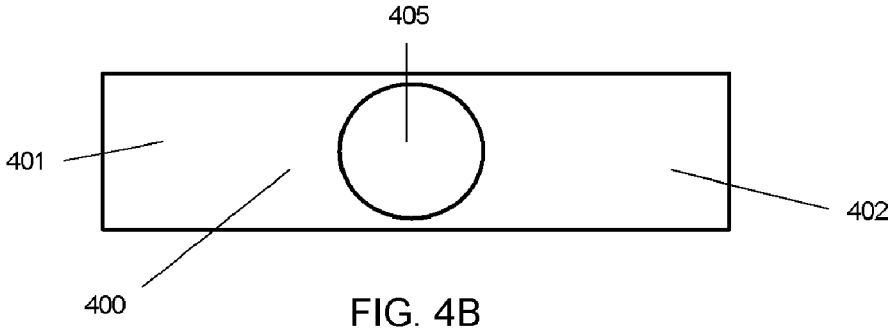
FIGS. 4A-4C respectively show a side view, a top view and an end view of a second exemplary embodiment of a sleeve-joint coupling for a trampoline frame according to the present invention.
Figure 4A:
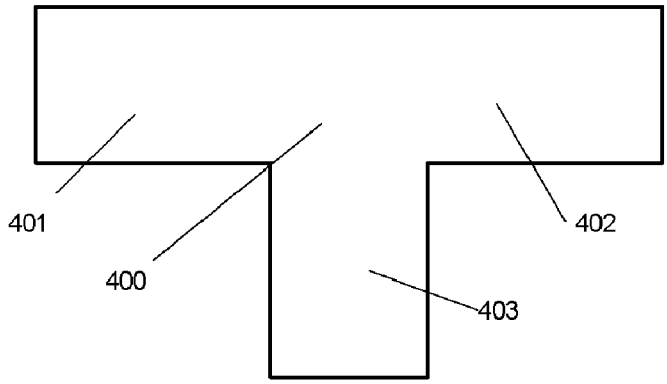
Figure 4C:
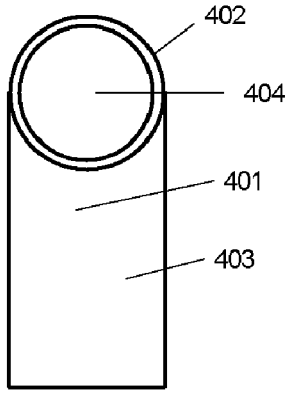

FIGS. 4A-4C respectively show a side view, a top view and an end view of a second exemplary embodiment of a sleeve-joint coupling 400 for a trampoline frame according to the present invention. Sleeve-joint coupling 400 is generally shaped as a "T" and includes three arm members 401-403, each having a generally round cross-sectional shape. Each arm member 401-403 receives a trampoline frame member (not shown in FIGS. 4A-4C) of similar cross-sectional shape into an opening 404 (FIG. 4C). Sleeve-joint coupling 400 includes an opening 405, shown in FIG. 4B, that receives a safety enclosure vertical pole member (not shown in FIGS. 4A-4C) having a generally round cross-sectional member.

Figure 5B:
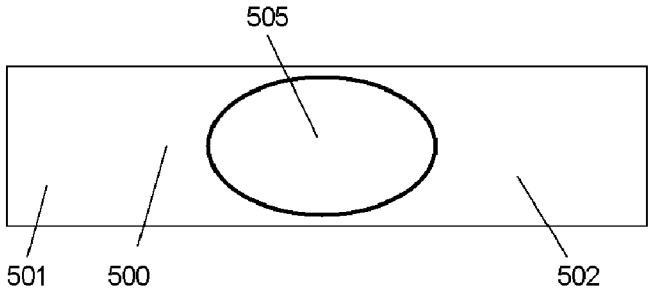
FIGS. 5A-5C respectively show a side view, a top view and an end view of a third exemplary embodiment of a sleeve-joint coupling for a trampoline frame according to the present invention.
Figure 5A:
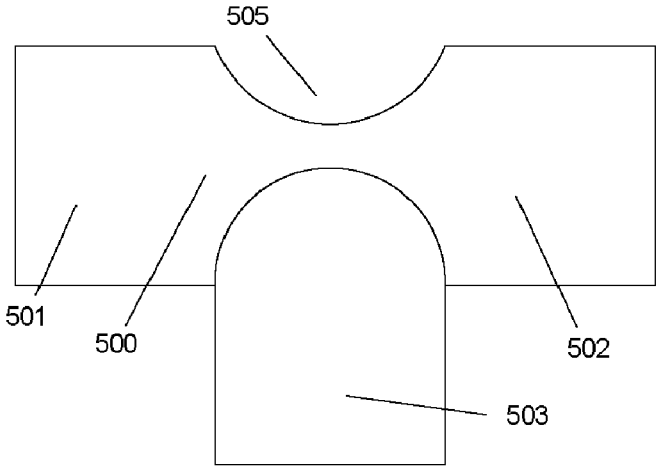
Figure 5C:
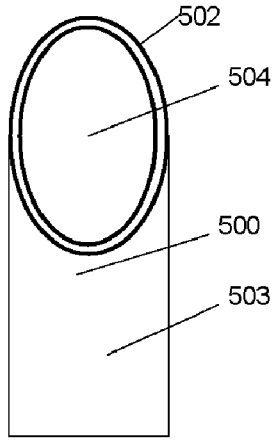

FIGS. 5A-5C respectively show a side view, a top view and an end view of a third exemplary embodiment of a sleeve-joint coupling 500 for a trampoline frame according to the present invention. Sleeve-joint coupling 500 is generally shaped as a "T" and includes three arm members 501-503, each having a generally oval cross-sectional shape. Each arm member 501-503 receives a trampoline frame member (not shown in FIGS. 5A-5C) of similar cross-sectional shape into an opening 504 (FIG. 5C). Sleeve-joint coupling 500 includes an opening 505, shown in FIG. 5B, that receives a safety enclosure vertical pole member (not shown in FIGS. 5A-5C) having a generally oval cross-sectional member.

Figure 6B:
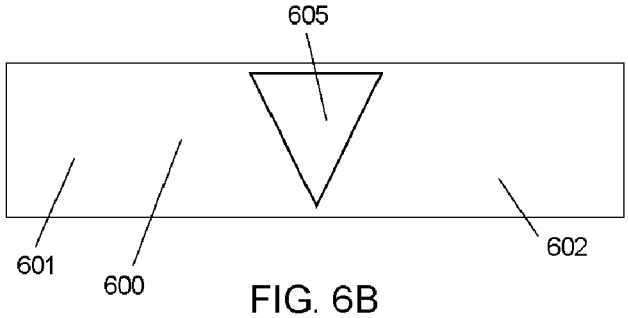
FIGS. 6A-6C respectively show a side view, a top view and an end view of a fourth exemplary embodiment of a sleeve-joint coupling for a trampoline frame according to the present invention.
Figure 6A:
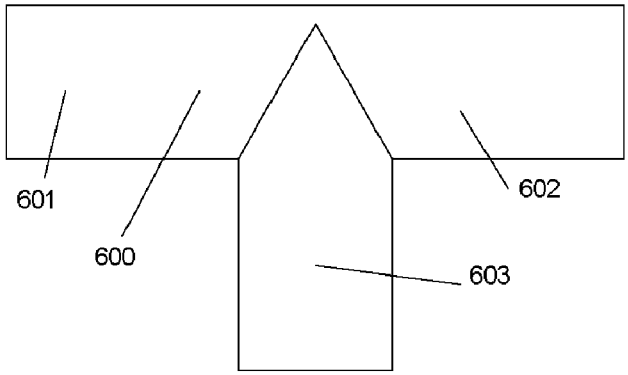
Figure 6C:
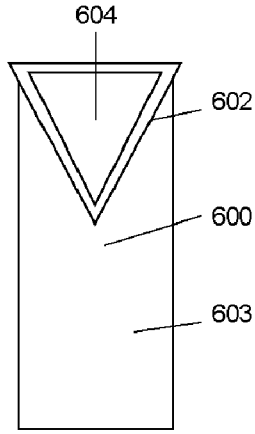

FIGS. 6A-6C respectively show a side view, a top view and an end view of a fourth exemplary embodiment of a sleeve-joint coupling 600 for a trampoline frame according to the present invention. Sleeve-joint coupling 600 is generally shaped as a "T" and includes three arm members 601-603, each having a generally triangular cross-sectional shape. Each arm member 601-603 receives a trampoline frame member (not shown in FIGS. 6A-6C) of similar cross-sectional shape into an opening 604 (FIG. 6C). Sleeve-joint coupling 600 includes an opening 605, shown in FIG. 6B, that receives a safety enclosure vertical pole member (not shown in FIGS. 6A-6C) having a generally triangular cross-sectional member.

Figure 7B:
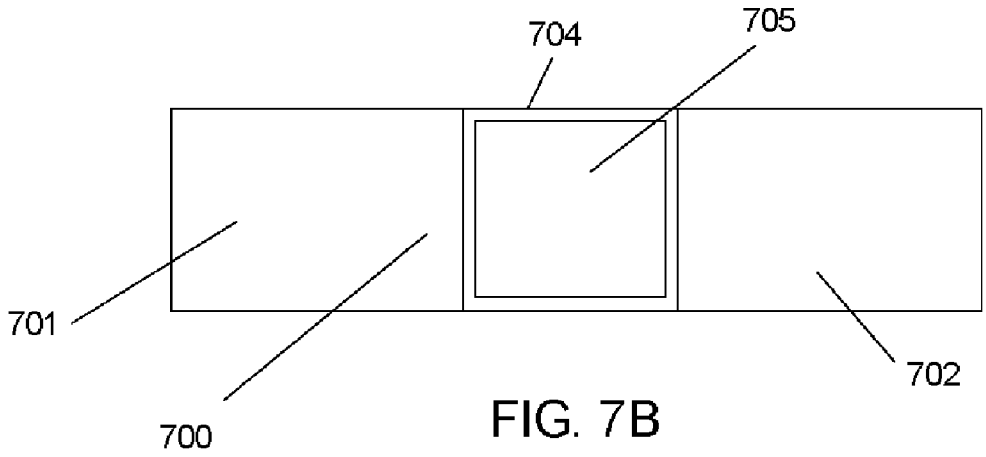
FIGS. 7A and 7B respectively show a side view and a top view of a fifth exemplary embodiment of a sleeve-joint coupling for a trampoline frame according to the present invention.
Figure 7A:
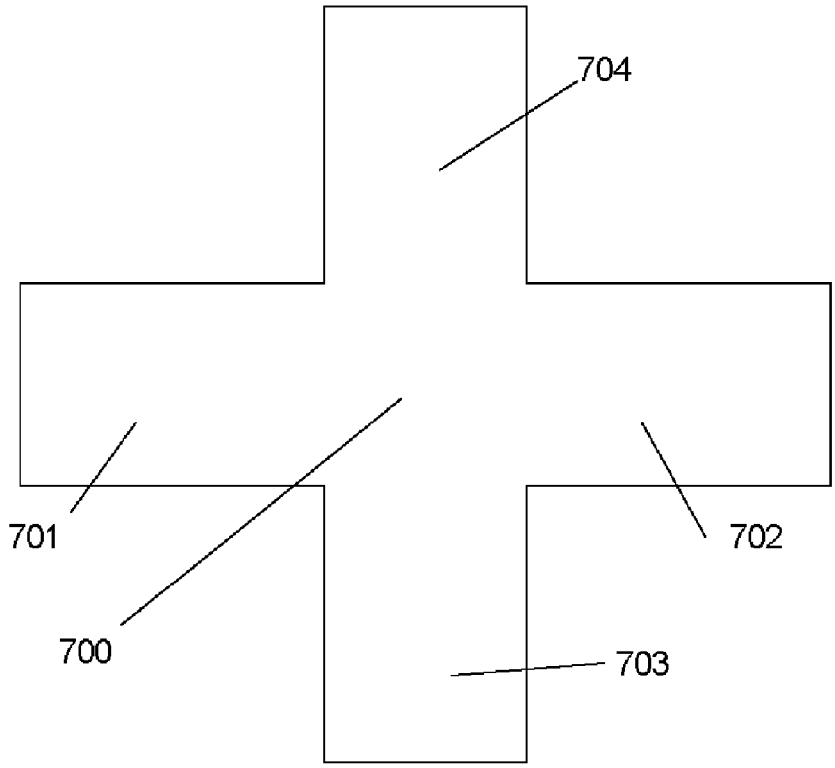

FIGS. 7A and 7B respectively show a side view and a top view of a fifth exemplary embodiment of a sleeve-joint coupling 700 for a trampoline frame according to the present invention. Sleeve-joint coupling 700 is generally shaped as an "X" or a "+" and includes four arm members 701-704, each having a generally square cross-sectional shape. Each arm member 701-704 receives a trampoline frame member (not shown in FIGS. 7A and 7B) of similar cross-sectional shape into an opening 705, of which only one opening 705 is shown (FIG. 7B). Each opening 705 receives a safety enclosure vertical frame member 103, a circular frame member 104 or a vertical pole member 105 (none of which are shown in FIGS. 7A and 7B) having a generally square cross-sectional member. It should be understood that sleeve-joint coupling 700 can have an alternative cross-sectional shape, such as any of the exemplary cross-sectional shapes described herein, and a mating vertical frame member, circular frame member and vertical pole member would have a corresponding cross-sectional shape.

Figure 8B:
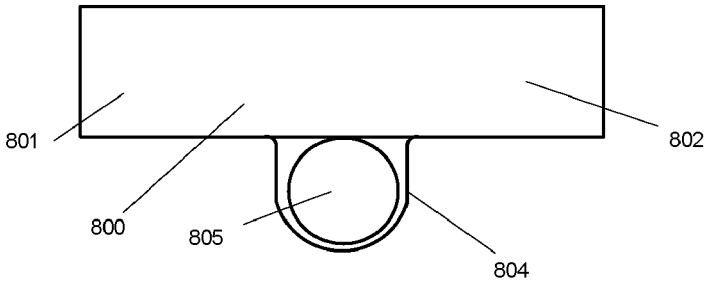
FIGS. 8A-8C respectively show a side view, a top view and an end view of a sixth exemplary embodiment of a sleeve joint coupling for a trampoline frame according to the present invention.
Figure 8A:
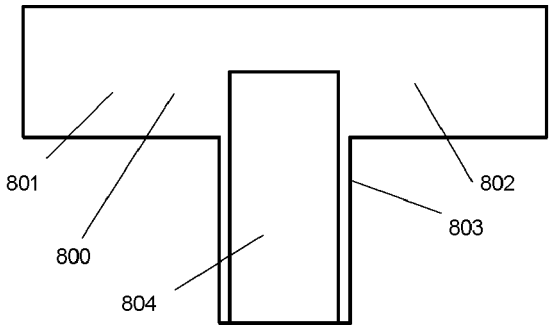
Figure 8C:
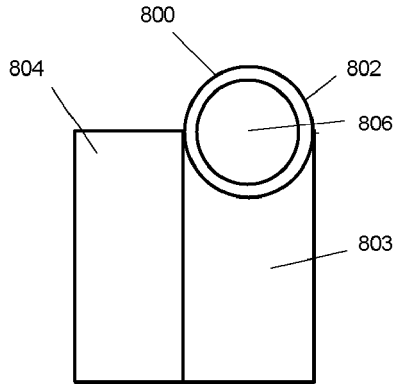

FIGS. 8A-8C respectively show a side view, a top view and an end view of a sixth exemplary embodiment of a sleeve-joint coupling 800 for a trampoline frame according to the present invention. Sleeve-joint coupling 800 is generally shaped as a "T" and includes three arm members 801-803, each having a generally round cross-sectional shape. Sleeve-joint coupling 800 also includes a side-sleeve member 804 having an aperture 805, configured as a blind hole, that receives a safety enclosure vertical pole member (not shown in FIGS. 8A-8C) having a generally round cross-sectional member. Side-sleeve member 804 has sufficient length and strength to allow a safety enclosure vertical pole to extend into side sleeve member 804 so that the vertical pole would not come out during use. Each arm member 801-803 receives a trampoline frame member (also not shown in FIGS. 8A-8C) of similar cross-sectional shape into an opening 806 (FIG. 8C). In an alternative embodiment, aperture 805 could be configured to allow a safety enclosure vertical pole to extend through the length of the side-sleeve member 804 to the ground or to another device that fastens the vertical pole to the corresponding frame member 103. In yet another alternative embodiment, side sleeve member 804 could have a slot that extends from at least one end of side-sleeve member 804 toward the other end of side-sleeve member 804 such that aperture 805 is not completely enclosed. It should be understood that the slot could extend part of or the entire length of side-sleeve member 804.

Figure 9:
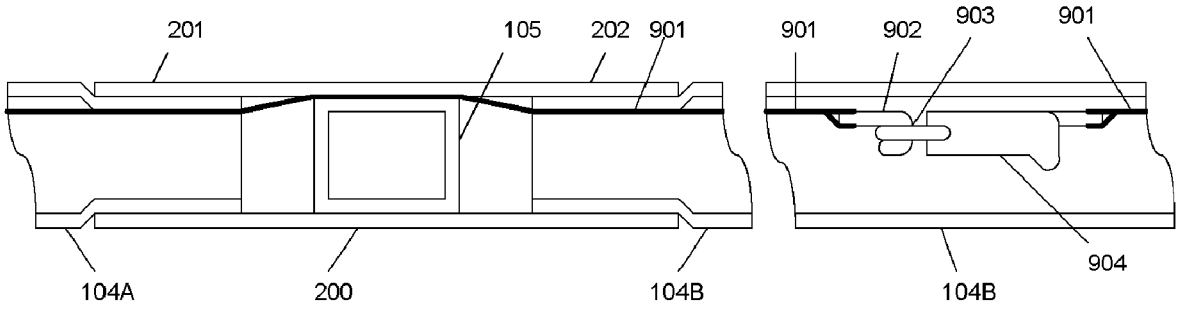

FIG. 9 depicts a top cutaway view of the first exemplary embodiment of a sleeve-joint coupling 200 according to the present invention. Two circular frame members 104A and 104B are shown in FIG. 9 respectively engaging arm members 201 and 202 of sleeve-joint coupling 200. A vertical pole member 105 of a safety enclosure is also shown. A tension member 901, such as a strap of webbing, a wire or a cable, is shown threaded through circular frame members 104A and 104B and sleeve-joint coupling 200, in addition the other circular frame members and sleeve-joint coupling forming a trampoline frame. Tension member 901 is fastened in a well-known manner to a hook assembly 902 that engages a loop 903 of a buckle assembly 904 that is accessible through a hole (not shown) in circular frame member 104B. Buckle assembly 904 has two positions; an open position that allows hook assembly 902 and loop 903 to be conveniently engaged, and a closed assembly that places tension member 901 under tension. When tension member 901 is under tension, each sleeve-joint coupling 200 that tension member 901 passes through is urged toward the center of the trampoline frame structure, thereby making the joints of frame structure even more reliable. Alternatively, a plurality of tension members can be used to form a line of continuous tension around a trampoline frame instead of a single tension member, as depicted in FIG. 9. As yet another alternative, tension member 901 could be attached to the outside of sleeve-joint coupling 200, such as through a loop fastened to the outside of sleeve-joint coupling 200. Still another alternative provides that a turn-buckle arrangement is used for placing tension on tension member 901.

While exemplary trampoline 100 shown in FIG. 1 is depicted as being round, it should be understood that the present invention could be used with a trampoline and safety enclosure having a different shape, such as square, rectangular or oval. Additionally, the sleeve-joint coupling of the present invention can be made from any suitable material that has sufficient strength to bear the loads and stresses that are associated with trampolines, such as metals and plastics. Further, while the sleeve-joint coupling of the present invention has been described in terms of vertical frame members and circular frame members fitting into the sleeve-joint coupling, it should be understood that the sleeve-joint coupling of the present invention can be configured so that one or all of the arm members of the sleeve-joint coupling fit into vertical frame members and circular frame members of the trampoline frame. Further still, while the sleeve-joint coupling of the present invention has been described as having several exemplary cross-sectional shapes, it should be understood that a sleeve-joint coupling according to the present invention could have any cross-sectional shape or have arm members having different cross-sectional shapes. As yet another alternative, the sleeve-joint coupling of the present invention could be formed to be part of a vertical frame member. As still another alternative, the sleeve-joint coupling of the present invention could be configured to substantially form a "T".

While the vertical pole members 105 of safety enclosure 101 has been described as extending into vertical frame members 103, it should be understood that at least one or more vertical pole member 105 of safety enclosure 101 could extend to the ground along the outside of a vertical frame member 103, in which case such a vertical pole member would be attached to the corresponding vertical frame member at a minimum of two places, such as by using a sleeve-joint coupling similar to that shown in FIGS. 8A-8C and, for example, a tie-wrap device near the bottom of a vertical frame member 103.

Figure 10:
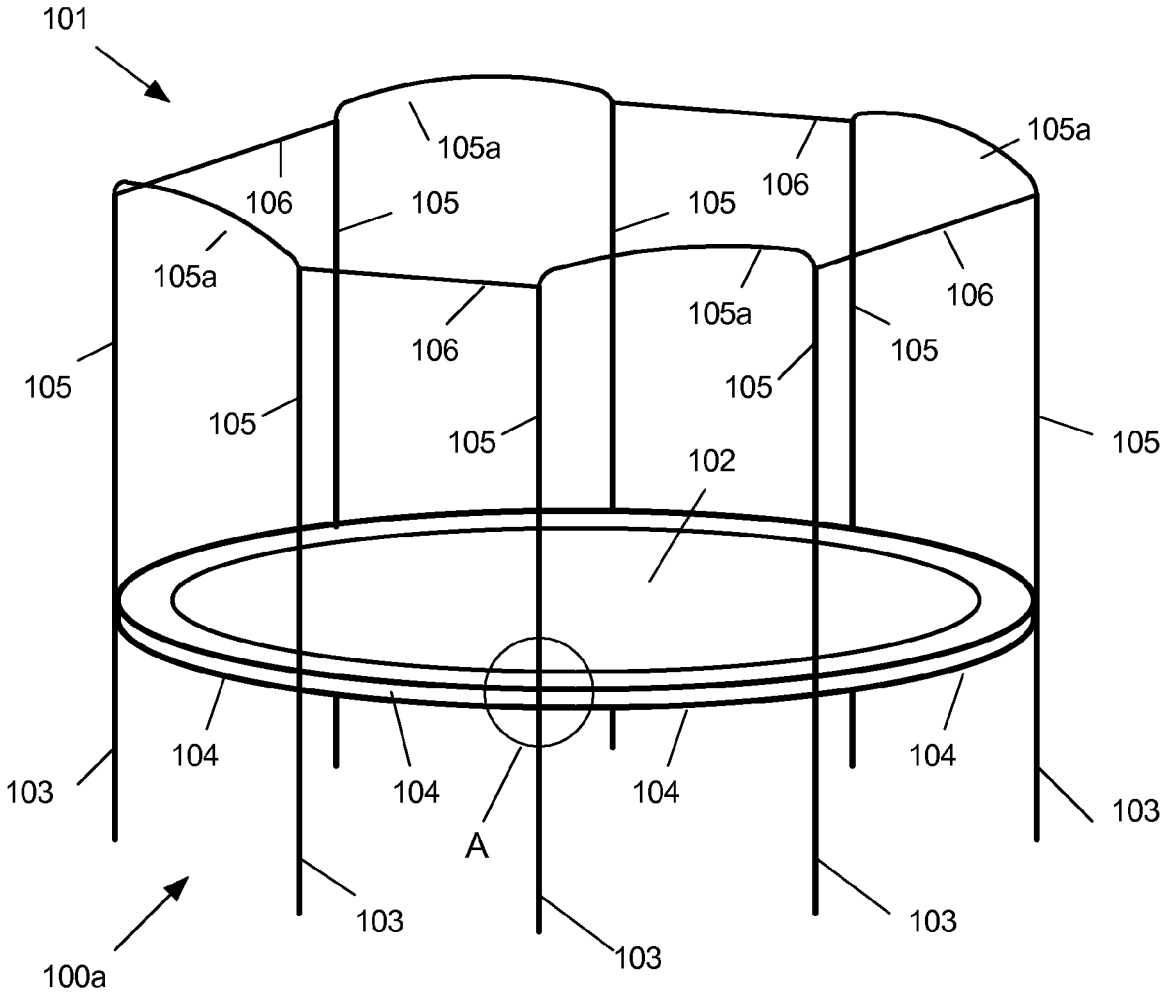
FIG. 10 depicts a perspective view of an exemplary trampoline having an exemplary alternative embodiment of a safety enclosure.

As yet another alternative embodiment, a safety enclosure vertical pole member 105 could be configured to form an arch (105*a* of trampoline 100*a* in FIG. 10), or an arc shape, between two frame members 103. The two frame members 103 could be adjacent or could be separated by one or more other frame members 103. A horizontal support member would then be connected between adjacent peaks of an arch in a substantially inflexible manner.

Although the foregoing invention has been described in some detail for purposes of clarity of understanding, it will be apparent that certain changes and modifications may be practiced that are within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A recreational structure frame system comprising:

a first frame member;

a second and third frame member;

a pole member;

a sleeve joint coupling that includes a first arm with a first passage, a second arm with a second passage, a third arm with a third passage, and an aperture, the first, second, and third passages extending substantially perpendicular to each other, the second and third passages each having an axial length and a respective axis, the second and third passages each including a rectangular cross section taken perpendicular to the respective axis, the rectangular cross section of the second passage remaining substantially constant along substantially the entirety of the length of the second passage, the rectangular cross section of the third passage remaining substantially constant along substantially the entirety of the length of the third passage, the first frame member being received in the first passage, the second frame member being received in the second passage, the third frame member being received in the third passage, and the pole member being received in the aperture; and a tension member that is operably coupled to both the second and third frame members and that applies a force between the second and third frame members to compress the second and third frame members toward each other.

2. The recreational structure frame system of claim 1, further comprising a safety enclosure that includes the pole member.

3. The recreational structure frame system of claim 1, wherein the aperture comprises one of a blind aperture or a through aperture.

4. The recreational structure frame system of claim 1, wherein the first, second, and third frame members are part of a trampoline frame structure.

5. The recreational structure frame system of claim 1, wherein the tension member extends internally through the second frame member, through the third frame members, and through the sleeve joint coupling.

6. A trampoline comprising:

a first frame member;

a second frame member;

a third frame member;

a pole member;

a sleeve joint coupling that couples the first, second, and third frame members and the pole member, the sleeve joint coupling including a first arm with a first passage, a second arm with a second passage that is rectangular in cross section, a third arm extending away from the second arm and including a third passage that is rectangular in cross section, and an aperture, the first passage having a first axis, the second and third passages sharing a substantially common axis, the first axis being substantially perpendicular to the substantially common axis, the first frame member being received in the first passage, the second frame member being received in the second passage, the third frame member being received in the third passage, and the pole member being received in the aperture to extend away from the first frame member; and a tension member that is operably coupled to both the second and third frame members and that applies a force between the second and third frame members to compress the second and third frame members toward each other.

7. The trampoline of claim 6, wherein the tension member extends internally through the second frame member, through the third frame members, and through the sleeve joint coupling.

8. The trampoline of claim 6, wherein the aperture defines an aperture axis that is substantially parallel to the first axis.

9. The trampoline of claim 8, wherein the aperture axis is spaced apart from the first axis.

10. The trampoline of claim 6, further comprising an enclosure netting that is supported by the pole member.

11. A trampoline comprising:

a first frame member;

a second frame member;

a third frame member;

a pole member;

a sleeve joint coupling that couples the first, second, and third frame members and the pole member, the sleeve joint coupling including a first arm with a first passage, a second arm with a second passage, a third arm extending away from the second arm and including a third passage, and an aperture, the first passage having a first axis, the second and third passages sharing a substantially common axis, the first axis being substantially perpendicular to the substantially common axis, the first frame member being received in the first passage, the second frame member being received in the second passage, the third frame member being received in the third passage, and the pole member being received in the aperture to extend away from the first frame member; and a tension member that is operably coupled to both the second and third frame members and that applies a force between the second and third frame members to compress the second and third frame members toward each other.

12. The trampoline of claim 11, wherein the tension member extends internally through the second frame member, through the third frame members, and through the sleeve joint coupling.

13. The trampoline of claim 11, wherein the aperture defines an aperture axis that is substantially parallel to the first axis.

14. The trampoline of claim 13, wherein the aperture axis is spaced apart from the first axis.

15. The trampoline of claim 14, wherein at least one of the second and third passages has a substantially rectangular cross section.

16. The trampoline of claim 11, further comprising an enclosure netting that is supported by the pole member.

17. The recreational structure frame system of claim 1, wherein the sleeve-joint coupling further includes a side-sleeve member, and wherein the aperture is a side passage that extends through the side-sleeve member, the side passage having an axis that is disposed at a distance from an axis of the first passage.

18. The recreational structure frame system of claim 17, wherein the axis of the side passage is substantially parallel to the axis of the first passage.

* * * * *